US006579366B2

(12) United States Patent
Bernert et al.

(10) Patent No.: US 6,579,366 B2
(45) Date of Patent: Jun. 17, 2003

(54) COATING MACHINE FOR DIRECT OR INDIRECT COATING OF A MATERIAL WEB

(75) Inventors: Richard Bernert, Giengen (DE); Manfred Ueberschär, Gerstetten (DE); Eckhard Wozny, Heidenheim (DE); Dennis Fartheymüller, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 107 days.

(21) Appl. No.: 09/759,313

(22) Filed: Jan. 12, 2001

(65) Prior Publication Data

US 2001/0008118 A1 Jul. 19, 2001

(30) Foreign Application Priority Data

Jan. 14, 2000 (DE) ..... 100 01 392

(51) Int. Cl.[7] ..... B05C 5/00

(52) U.S. Cl. ..... 118/325; 118/123; 118/413; 118/419

(58) Field of Search ..... 118/325, 419, 118/122, 123, 117, 410, 234, 413

(56) References Cited

U.S. PATENT DOCUMENTS

| | | | | |
|---|---|---|---|---|
| 4,375,202 A | | 3/1983 | Miller | 118/117 |
| 4,569,304 A | * | 2/1986 | Le Maitre | 118/419 |
| 5,522,931 A | * | 6/1996 | Iwashita et al. | 118/410 |
| 5,603,767 A | | 2/1997 | Damrau | 118/410 |
| 5,772,766 A | * | 6/1998 | Reich et al. | 118/413 |
| 6,033,477 A | | 3/2000 | Ueberschär | 118/413 |
| 6,126,751 A | * | 10/2000 | Bernert et al. | 118/410 |

FOREIGN PATENT DOCUMENTS

| | | | |
|---|---|---|---|
| DE | 43 02 373 A1 | 8/1994 | D21H/23/34 |
| DE | 44 32 177 A1 | 3/1996 | B05B/1/04 |
| DE | 195 24 702 C1 | 10/1996 | B05C/11/02 |
| DE | 197 19 128 A1 | 11/1998 | B05C/5/02 |
| DE | 198 58 653 | 12/1998 | D21H/24/34 |
| DE | 299 13 677 U1 | 10/1999 | B05C/5/02 |
| EP | 0 319 503 B1 | 5/1993 | B05D/1/00 |
| EP | 0 846 804 A1 | 11/1997 | D21H/23/32 |

* cited by examiner

*Primary Examiner*—Richard Crispino
*Assistant Examiner*—Yewebdar T Tadesse
(74) *Attorney, Agent, or Firm*—Taylor & Aust, P.C.

(57) ABSTRACT

A coating machine for directly or indirectly applying a coating to a material web is designed to apply liquid or viscid coating medium onto a moving surface. The coating machine includes a discharge nozzle for discharging a coating medium onto the moving surface. The discharge nozzle has a first nozzle lip residing on the feed-side, and a second nozzle lip residing on the trailing side with respect to the moving surface. At least one of the first and second nozzle lips is composed of a blade element.

32 Claims, 6 Drawing Sheets

COATING MACHINE FOR DIRECT OR INDIRECT COATING OF A MATERIAL WEB

BACKGROUND OF THE INVENTION

1. Field of the Invention

This invention relates to a machine designed for direct or indirect application of a liquid or viscid coating medium onto a moving surface; whereby, in the case of direct application, the moving surface is the outer surface of a material web such as paper or cardboard, or, in the case of indirect application, the moving surface is the outer surface of a transfer element, preferably a transfer roll capable of transferring coating medium onto the material web; and whereby the coating machine includes a discharge nozzle for the purpose of discharging coating medium onto the surface with nozzle lips that reside on the feed-side and trailing side with respect to the moving surface.

2. Description of the Related Art

Generic free-jet nozzle coating machines are known from documents DE 44 32 177 A1, EP 0 846 804 A1 and U.S. Pat. No. 5,603,767. These documents describe designs in which one of the nozzle lips is mounted rigidly, the other nozzle lip being adjustable for the purpose of varying the height of the nozzle gap. None of the disclosed free-jet nozzle coating machines allow the adjustment of the nozzle gap to occur quickly and temporarily or allow the opening thereof in such a manner to "blow out" contaminants which tend to lower the quality of the coating.

SUMMARY OF THE INVENTION

The present invention relates to a coating machine of the type mentioned above which provides an improved mechanism to adjust the height of the nozzle gap.

The invention comprises, in one form thereof, a coating machine of the type mentioned above, the machine including nozzle lips of which at least one of them being formed by a blade element. By applying an elastic nozzle lip, the nozzle gap can be quickly and temporarily enlarged so that the pressure of the coating medium being supplied to the nozzle gap temporarily increases. Such a pressure pulse not only widens the nozzle gap as a result of any deflection of the blade element but also loosens any contaminants and literally blows them out of the nozzle gap. After the pressure pulse has subsided, the blade element reverts to its original position and the nozzle gap reliably changes to its original height. The blade element is preferably manufactured from steel. It is also possible to use blade elements made of fiber-reinforced plastic and, in particular, blade elements made of carbon fiber-reinforced plastic (CFRP), glass fiber-reinforced plastic (GFK), or a similar material.

In a further embodiment of this invention, the coating machine incorporates a mechanism for adjusting the height of the nozzle gap. Such a mechanism permits a variation of the coating medium being applied onto the moving surface by the coating machine with respect to a unit time.

In accordance to a first embodiment, the adjusting mechanism acts upon the blade element. In accordance to a first adjustment device of this first embodiment, the blade element can be deformed or pivoted by an adjusting unit of the adjusting mechanism. More specifically, the height of the nozzle gap can either be increased or decreased by a corresponding activation of the adjusting mechanism, starting from an initial base position of the blade element which is unaffected by the adjusting mechanism.

From a design perspective, the case of increasing the height can be accomplished by holding the blade element with one of its own length-wise edges (positioned in a transverse direction) against the coating machine, the blade element being further supported at the coating machine at a position between its two length-wise edges, and by allowing the adjusting unit to act upon the blade element at a position that is located between the support position and the mounting edge, extending in a length-wise direction.

Increasing the height can be accomplished by holding one of the blade element's own length-wise edge (positioned in a transverse direction) against the coating machine and by allowing the adjusting unit to act upon the blade element, causing it to bend at a position that is located between the length-wise mounting edge and the free length-wise edge. Alternatively, the blade element can also be mounted via a pivot bearing. The adjusting mechanism can then pivot the blade element against an opposing spring force. Alternatively, the adjusting mechanism may include two partial adjusting mechanisms that act upon the blade element in opposite directions.

If there is a preferred operating height of the nozzle gap, a mechanical stop can be provided which defines a condition of maximum deflection or pivoting movement of the blade element corresponding to the desired operating gap height. In this condition, the gap height is essentially independent from the adjusting force of the adjusting mechanism, which simplifies the control of the adjusting mechanism.

In a further embodiment of this invention, at least one safety element is provided, which works in concert with the blade element and provides a secure mounting in the appropriate mounting receptacle of the coating machine.

The adjusting unit may include, for example, at least one pivoting lever having a fulcrum arrangement. Specifically, the free end of the fulcrum arrangement acts upon the blade element, and the other free end of the fulcrum arrangement can be moved by a force-generating device having a force-generating arrangement. By applying the fulcrum arrangement, the force-generating arrangement must not be located in the immediate vicinity of the discharge nozzle, where typically not much space is available. Instead, such a force-generating arrangement can be placed in an area where space is more readily available.

A pressure hose arrangement can be used as a force-generating arrangement. Alternatively, one can also use pneumatic, hydraulic, hydro-pneumatic, electric, electrochemical, or any other applicable devices.

In yet a further embodiment, the force-generating arrangement includes a plurality of force-generating devices, allowing such forces to be distributed perpendicular to the surface. This makes it possible to adjust the height of the nozzle gap in several sections along the working width of the surface independently from one another, which allows a cross-profiling of the coating being applied onto the surface.

The pivot bearing of the fulcrum lever arrangement and/or the minimum of one force-generating device can each be mounted on a distribution pipe or a part connected to it.

An alternative adjusting methodology of the first embodiment allows the blade element to be placed in a mounting receptacle that can be adjusted by the adjusting mechanism. In this case, the mounting can be made of a joint element having cylinder segments. Specifically, the joint element is placed in a socket, which is connected to the distribution pipe or a part mounted to it. The adjusting mechanism can act upon the joint element on the side of the coating machine, for example, either on the drive side or on the guide side of the coating machine where there is sufficient room available.

In an even further embodiment of the coating of the present invention, it is also possible for the adjusting mechanism not to act upon the nozzle lip which includes the blade element but to act upon a second nozzle lip which has no blade element. A joint element, composed of cylinder segments, is part of the second nozzle lip and is movable in a socket via an adjusting mechanism, which, in turn, should be attached to the distribution pipe or a part mounted to it. Furthermore, the second nozzle lip can be an integrated element of the joint element or made as an individual piece connected to the joint element. For the latter, it is fluid-dynamically preferred for the joint element to be, in essence, tear-dropped shaped. Specifically, the area of the section which is supported by the socket has essentially the outline of a circle while the section forming the nozzle lips decreases to a sharp corner. Again, the adjusting mechanism can act upon at least one of the ends of the joint elements, either on the drive side or the guide side of the coating machine.

If both nozzle lips are part of the adjusting mechanism, the coating machine can, in accordance to the present invention, not only affect the nozzle height by a coordinated adjustment of the position of both nozzle lips but also the direction of the jet of the coating medium exiting the discharge nozzle, without having to change the position of the coating machine. This is especially advantageous because the optimum angle of the cooling medium jet with respect to the moving surface can be achieved by adjusting parts that have relatively low mass inertias and can accordingly be adjusted correspondingly fast.

The adjustment of the two nozzle lips can also be performed in a manner such that the nozzle lip formed by the blade element can be moved from an idle position to an operational position at which it shall remain during operation. For example, the blade element can be moved against a mechanical stop, as already mentioned above. The height adjustment of the nozzle gap during normal operation is accomplished by adjustment of the other nozzle lip. To "flush out" the nozzle gap, it is, however, possible to temporarily move the blade element from the operational position to the idle position. The widening in the nozzle height achieved through this procedure can, if so desired, be assisted by the pressure pulse generated by the widening of the nozzle gap.

In a further embodiment of this invention, the nozzle lips are formed of a minimum of two shell-like or shell shaped pieces, which together form the walling of a distribution channel located upstream of the discharge nozzle with respect to the flow of the coating medium. Such shell-like pieces are easier to manufacture using cast or extrusion manufacturing technologies rather than are profile pipes, which, in turn, also benefits the manufacturing process of the coating machine of the present invention. The two shell-like pieces can also be manufactured of fiber-reinforced plastic, i.e., carbon fiber-reinforced plastic (CFRP), or Polyvinylchloride, (PVC), especially, chlorinated Polyvinylchloride (PVC-C). They can be connected to one another simply through adhesion, bolting, or a similar method.

Additionally, the shell-like pieces can form together an equalization chamber that resides between the distribution channel and the discharge nozzle, in which the coating medium exiting the distribution channel is equalized prior to entering the nozzle gap. Attached to the shell-like pieces, receptacles or mounting arrangements can be incorporated for each respective nozzle lip.

Finally, in a further embodiment of this invention, the coating machine includes a distribution channel located upstream of the discharge nozzle with respect to the coating medium flow; an equalization chamber that resides between the distribution channel and the discharge nozzle; and a device for accommodating an insert in the transitional section between the distribution channel and the equalization chamber, the device having a plurality of openings for the coating medium exiting the distribution pipe. This insert can, in accordance to this invention, be a "blending device" between the distribution channel and the equalization chamber and is designed so as to be interchangeable with an insert having a smaller or larger number of openings and/or openings with smaller or larger cross-sectional areas, in order to accommodate a variety of coating mediums with a range of viscosities.

A simplification of the coating machine construction and its components can be achieved by making the distribution pipe a separate entity from the associated carrier element or beam. This modular construction allows a relatively simple, thermally isolated attachment of the distribution pipe onto the carrier element. This avoids stresses associated with the entire apparatus, especially stresses in the distribution pipe, as a result of expansion differences between the carrier element and the distribution pipe. Different thermal expansion coefficients associated with the materials that are used for the different parts will therefore not have a negative impact on the coating quality.

Although the above embodiments are based on a free-jet coating machine that is positioned at a distance from the moving surface and is configured for applying coating medium onto the moving surface under high pressure using a free unsupported jet, the coating machine, as designed per this invention, can also be applied as a curtain coater, i.e., a coating machine with short dwell time (SDTA—short dwell time applicator). In the latter, the nozzle gap, delimited by the nozzle lips, forms the applicator chamber, in which the coating medium is brought into contact with the moving surface during a short residence time. With this design, the downstream nozzle lip can be designed to serve the function of applying the final metering and, if desired, of equalizing the coating medium being applied onto the surface. Alternatively, such a final metering/equalization function can be accomplished by a device that is mounted separately.

With curtain coaters, the coating medium is applied by taking advantage of gravity. This limits the amount of application so that final metering/equalization is no longer required.

BRIEF DESCRIPTION OF THE DRAWINGS

The invention is explained in more detail using several embodiments that are being by described by drawings which are included. The following applies.

Figure 1:
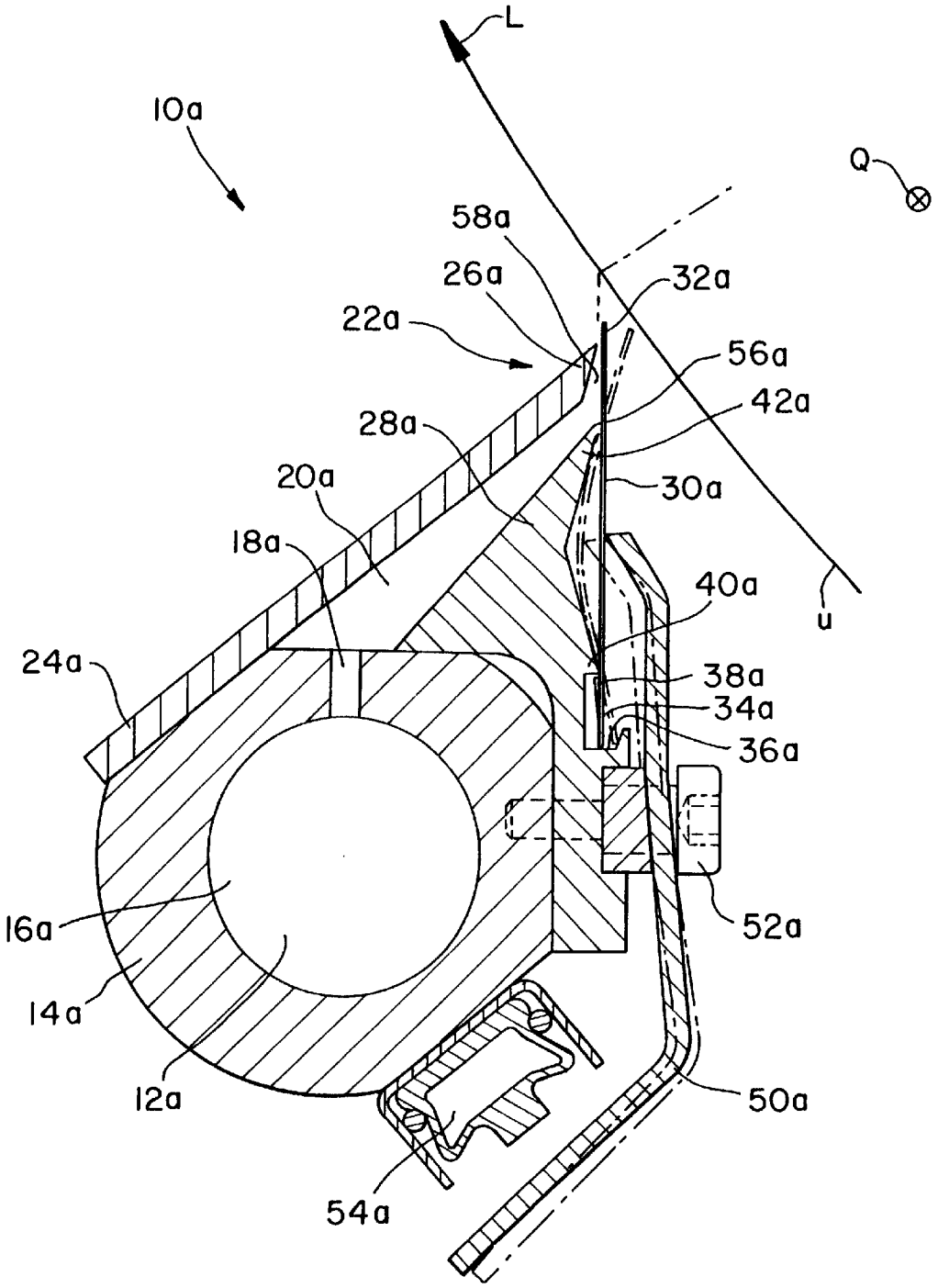
FIGS. 1–6 are schematic cross-sectional views of various embodiments of coating machines of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

In FIG. 1, the coating machine of the present invention is generally labeled 10*a*. It serves to apply a liquid or viscid coating medium 12*a* onto a moving surface U which traverses in a direction indicated by arrow L. Surface U can be the outer surface of a material web, i.e., a web made of paper or cardboard (direct application) or the outer surface of a transfer roll which transfers coating medium 12*a* onto the material web at a different location (indirect application).

Coating machine 10*a* includes distribution pipe 14*a*, which has an interior cavity 16*a*, positioned perpendicular to surface U. It is into interior cavity 16*a* where coating medium 12*a* is supplied. Distribution pipe 14*a* has a plurality of through-holes 18*a* formed in a transverse direction Q, through which coating medium 12*a* flows into equalization chamber 20*a*, which, in essence, extends across the entire working width of surface U and serves to equalize the flow of coating medium 12*a* exiting through-holes 18*a*. Coating medium 12*a* flows through equalization chamber 20*a* into discharge nozzle 22*a* from which it subsequently exits coating machine 10*a* in form of a jet, which impacts surface U.

Equalization chamber 20*a* is delimited by an essentially solid, flat element 24*a*, which is mounted on distribution pipe 14*a*, and onto whose downstream end forms nozzle lip 26*a*. Equalization chamber 20*a* is also delimited by adapter piece 28*a*, which is also mounted onto distribution pipe 14*a* and which further serves the purpose of retaining blade element 30*a*. The free end of blade element 30*a* forms the feed-side edge of nozzle lip 32*a* of discharge nozzle 22*a*. The mounting of equalization chamber delimiting parts 24*a* and 28*a* is best accomplished by a bolted connection. This approach is especially advantageous for part 24*a* as it facilitates easy replacement of trailing nozzle lip 26*a* for maintenance reasons.

Blade element 30*a* is attached by end 34*a* thereof which is opposite of nozzle lip end 32*a*, in mounting cavity 36*a* of second equalization chamber element 28*a*. Protruding tab 38*a* of blade element 30*a* engages into shoulder 40*a* of equalization chamber-delimiting element 28*a* and keeps blade element 30*a* from moving out of mounting receptacle 36*a* towards the top of FIG. 1. Additionally, blade element 30*a* is in contact with section 42*a* of second distribution chamber delimiting element 28*a*.

Further, lever 50*a* is provided which is mounted on lever bearing 52*a* in such a manner so as to allow it to pivot. Lever 50*a* is mounted to second equalization chamber-delimiting element 28*a*. Per FIG. 1, adjusting mechanism 54*a* acts upon the free end of lever 50*a* (FIG. 1 shows a pressure hose arrangement), through which lever 50*a* can be pivoted around lever bearing 52*a*. The upper end of lever 50*a* is in contact with blade element 30*a* in a location between mounting cavity 36*a* and support location 56*a* of blade element 30*a* at support section 42*a* of second distribution chamber delimiting element 28*a*. When activating adjusting mechanism 54*a*, lever 50*a* is moved to the position indicated by the dash-dot-dash line which causes it to bend, resulting in a widening of nozzle gap 58*a* formed by nozzle lips 26*a* and 32*a*. If the adjusting force of adjusting mechanism 54*a* is reduced, i.e., by lowering the gas pressure of the pressure hose, lever 50*a* is moved back with the help of its elastic properties to its original position, as indicated in FIG. 1 by the solid lines. This allows an adjustment of nozzle gap 58*a* by balancing the adjusting force of adjusting mechanism 54*a* and the spring force of blade element 30*a*.

Figure 2:
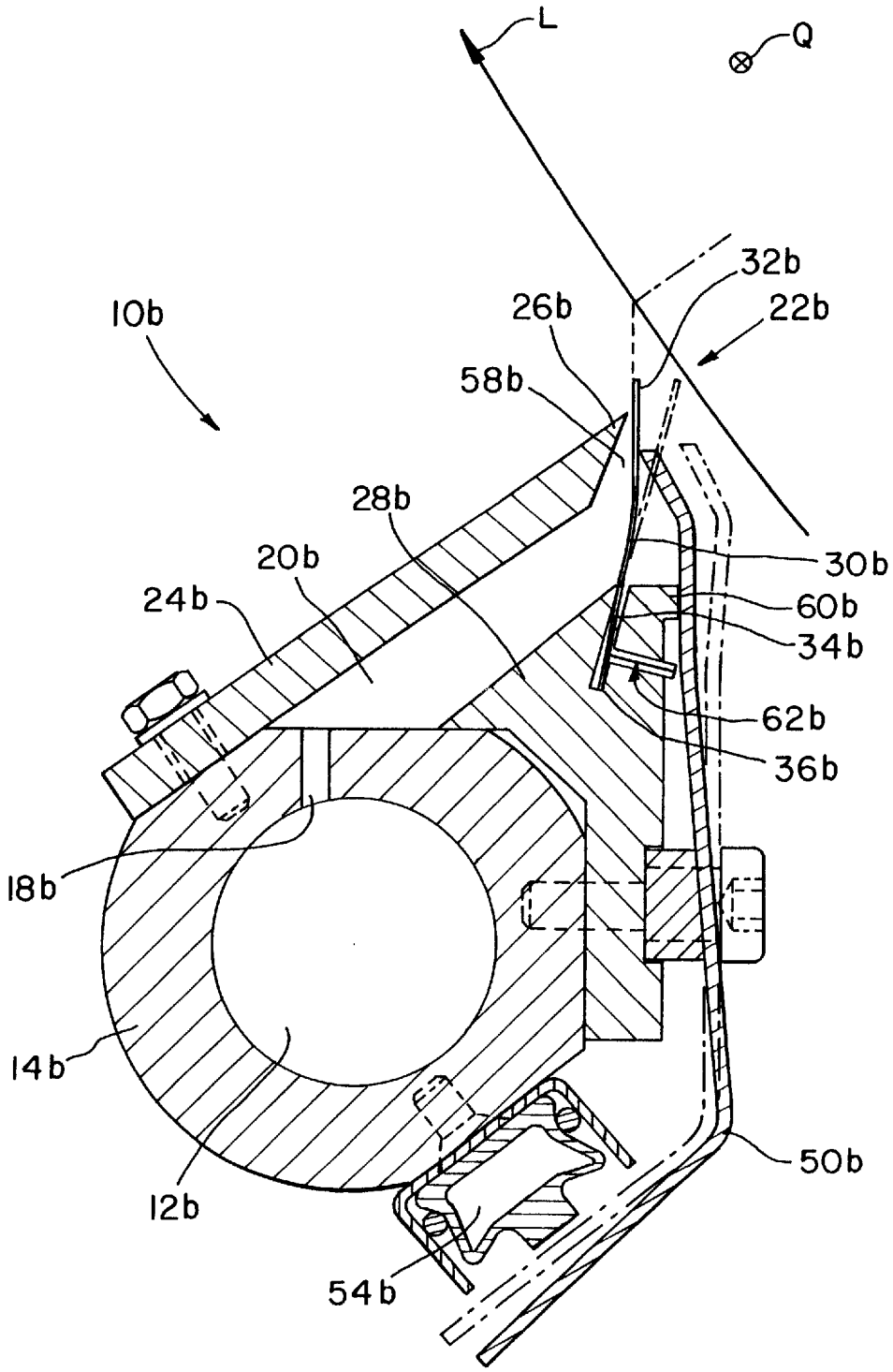

FIG. 2 illustrates a second embodiment of a coating machine and essentially corresponds to the one shown in FIG. 1. The same parts use the same reference numbers but are accompanied by the lower case letter "b" instead of the lower case letter "a". Furthermore, the embodiment shown in FIG. 2 is only described to the extent that it differs from the embodiment shown in FIG. 1, whose description expressly applies unless otherwise indicated.

Coating machine 10*b*, shown in FIG. 2, differs from coating machine 10*a* mainly by the fact that blade element 30*b* deforms in a manner causing a reduction in nozzle gap height 58*b* when activating lever 50*b* by activation mechanism 54*b*, i.e., by increasing the gas pressure of the pressure hose. This is achieved by blade element 30*b* being in contact solely via end 34*b* thereof in receptacle 36*b* with second equalization chamber-delimiting element 28*b* with no other support being utilized. The respective height of nozzle gap 58*b* is the result of the balance between the force generated by adjusting mechanism 54*b* and the spring force of deformed blade element 30*b*.

The embodiment shown in FIG. 2 further features mechanical stop 60*b* for lever 50*b* on second equalization chamber-delimiting element 28*b* which determines the maximum deflection of blade element 30*b* and, thus, the minimum height of nozzle gap 58*b*. Finally, the embodiment shown in FIG. 2 also features safety dowel 62*b* which is mounted in second equalization chamber-delimiting element 28*b* in such a manner as to cause it to be engaged with blade element 30 by lever 50*b* and thus securing it in receptacle 36*b*.

The detailed description of FIG. 1 still applies with respect to the supply of coating medium 12*b* through distribution pipe 14*b*, the passage of coating medium 12*b* through openings 18*b* in equalization chamber 20*b* being delimited by first equalization chamber-delimiting element 24*b*, the design of discharge nozzle 22*b* with nozzle lips 26*b* and 32*b*, etc.

Figure 3:
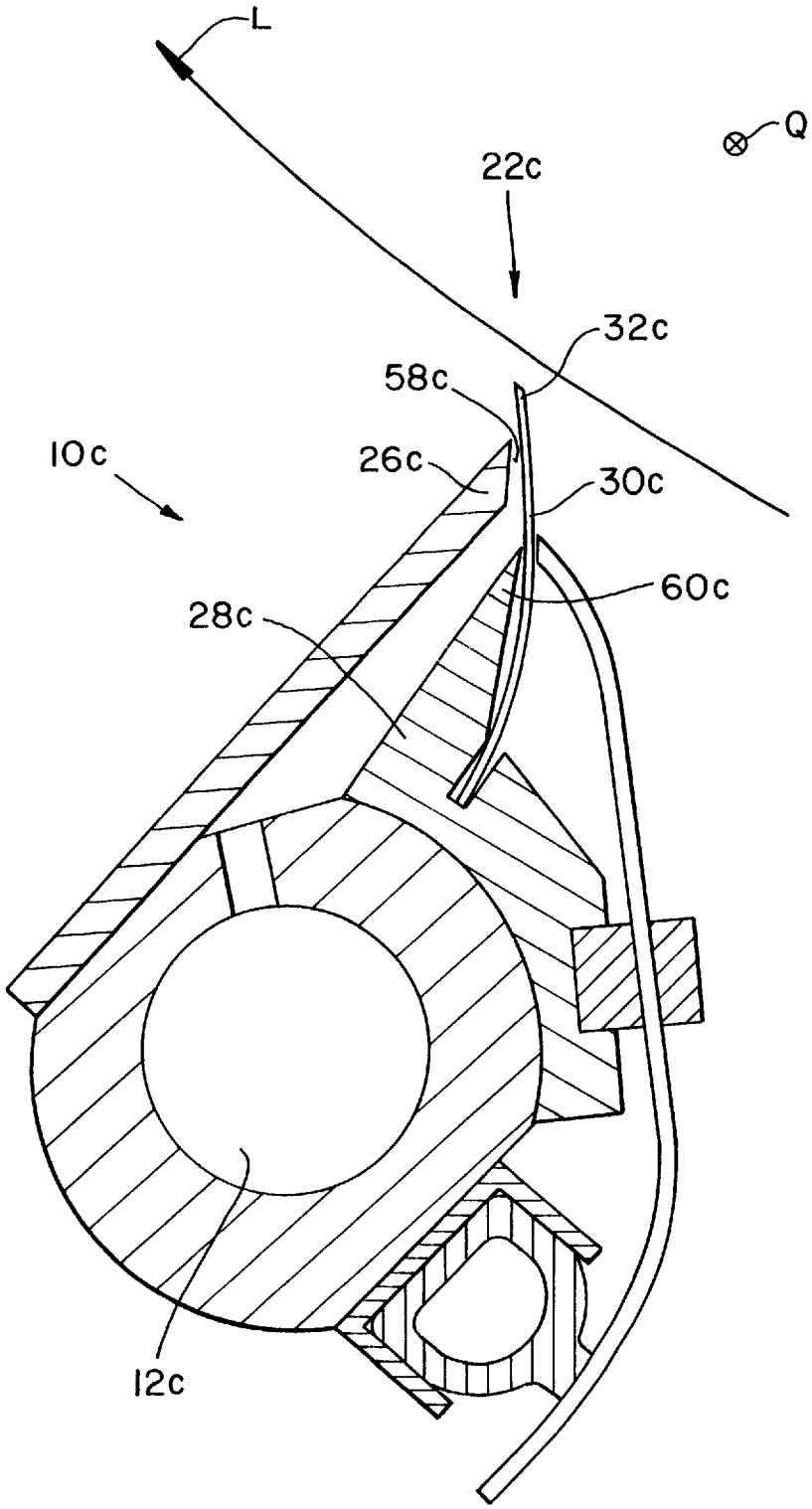

FIG. 3 illustrates an additional embodiment of a coating machine 10*c*, and essentially relates to the discussions of the previous embodiments. FIG. 3 uses for the same parts the same reference numbers as FIG. 1 but are accompanied by the lower case letter "c" instead of the lower case letter "a." Furthermore, the embodiment shown in FIG. 3 is only described to the extent that it differs from the embodiments shown previously whose description expressly applies unless otherwise indicated.

Coating machine 10*c*, depicted in FIG. 3, illustrates that mechanical stop 60*c* of second equalization chamber-delimiting element 28*c*, which limits the minimum opening height of nozzle gap 58*c*, can also serve as a mechanical stop for blade element 30*c*, which is different compared to the design shown in FIG. 2, which uses mechanical stop 60*b* for lever 50*b*. Otherwise, coating machine 10*c*, as shown in FIG. 3, corresponds in construction and functionality to coating machine 10*b* of FIG. 2, especially, as far as using discharge nozzle 20*c* and its nozzle lips 26*c* and 32*c* to facilitate the discharging of coating medium 12*c* is concerned.

Figure 4:
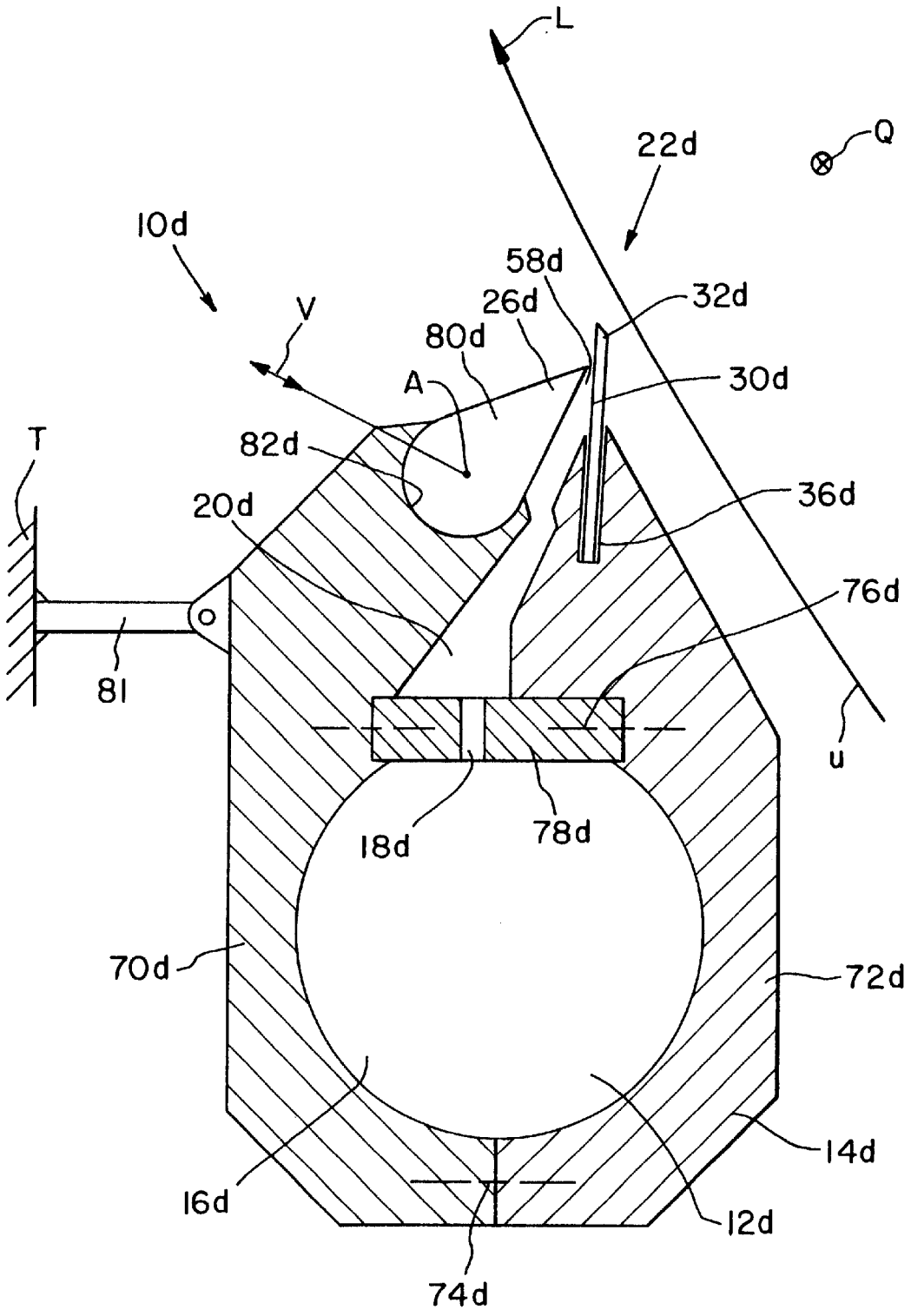

FIG. 4 illustrates an additional embodiment of a coating machine of the present invention, which essentially relates to the discussions of the previous embodiments. FIG. 4 uses for the same parts the same reference numbers as FIG. 1 but are accompanied by the lower case letter "d" instead of the lower case letter "a". Furthermore, the embodiment shown in FIG. 4 is only described to the extent that it differs from the embodiments shown previously whose description expressly applies unless otherwise indicated.

In coating machine 10*d* according to FIG. 4, coating medium 12*d* is supplied to distribution channel 16*d* of distribution pipe 14*d*, which is formed by two shell-like pieces 70*d* and 72*d*. In the embodiment shown, shell-like pieces 70*d* and 72*d* are connected to one another at location 74*d* and 76*d* by a bolted connection. Bolted connection 76*d* also incorporates insert 78*d* in which through-holes 18*d* are formed for the purpose of allowing coating medium 12*d* to flow into equalization chamber 20*d*. Equalization chamber 20*d* is also formed by shell-like pieces 70*d* and 72.

The upper end of shell-like piece 72*d* contains mounting cavity 36*d* into which blade element 30*d* is positioned and whose free end forms feed-side nozzle lip 32*d* of nozzle gap 58*d* of discharge nozzle 22*d* located adjacent to equalization chamber 20*d*. Trailing nozzle lip 26*d* is formed by a joint element 80*d*. Joint element 80*d* is essentially tear drop-shaped in its cross-section and is mounted in socket 82*d* formed in first shell-like piece 70*d* in a manner allowing it to be pivoted around its axis A. In order to adjust to the desired pivot position of joint element 80*d*, adjusting mechanism V (a lever arrangement, for example) is provided (shown schematically) and engages on at least one of the two ends of joint element 80*d*, specifically on the guide side and/or on the drive side of coating machine 10*d*.

FIG. 4 also depicts mounting arms 81 which serve to support the coating machine on a carrier element T, i.e., a coater beam, and whose depiction also applies to the other embodiments of the present invention. The mounting arms are distributed at a distance of approximately 1,200 mm from one another across the entire machine width, and are attached in an articulated fashion to distribution pipe 14*a–c* (FIGS. 1 through 3) or shell-like piece 70*d* and 72*d* (FIG. 4 and beyond). This provides a simple and cost-effective thermal isolation of distribution pipe 14*a–c* from carrier element T.

Figure 5:
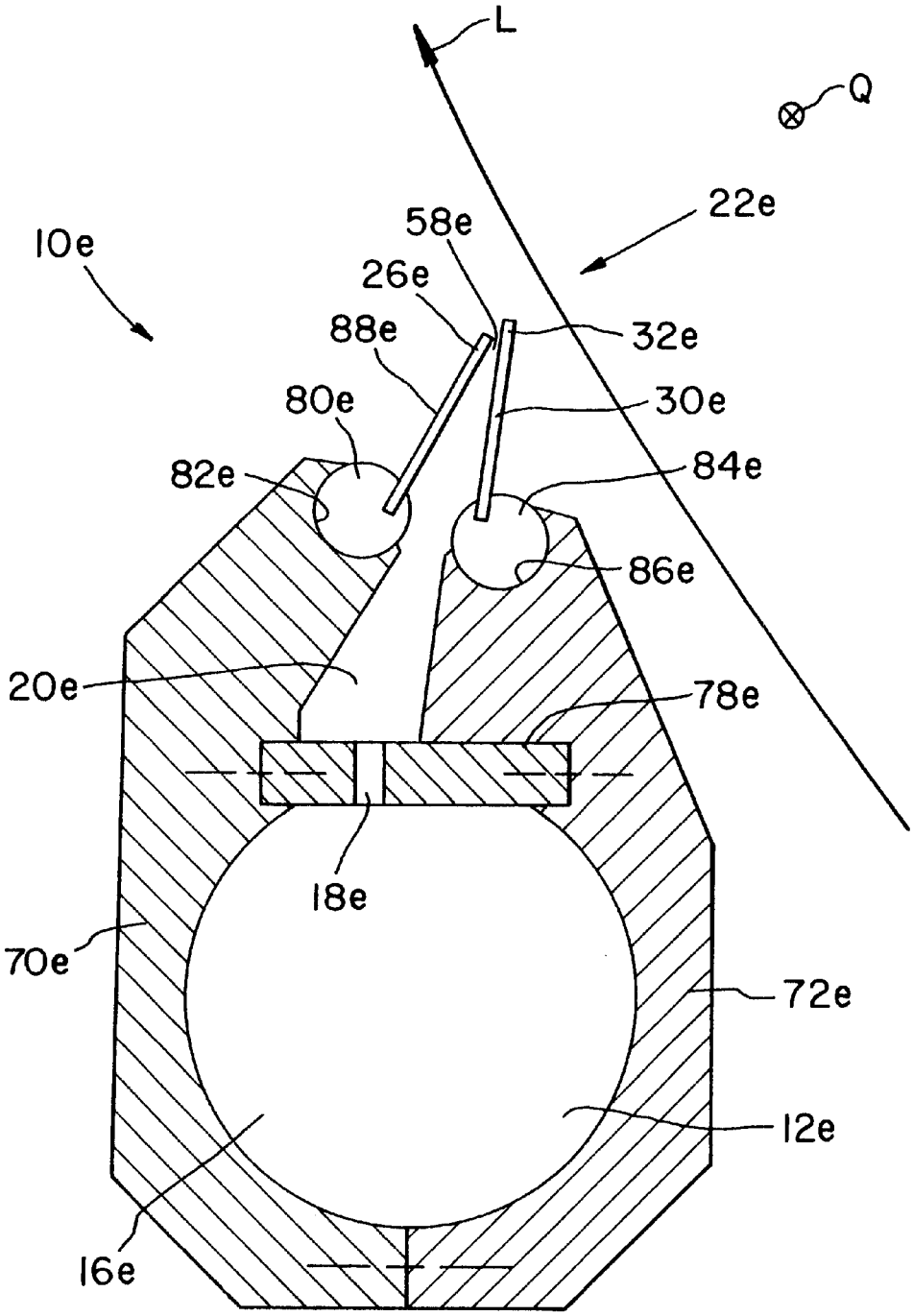

FIG. 5 depicts an additional embodiment of a coating machine of the present invention and essentially relates to the discussions of the previous embodiments. FIG. 5 uses for the same parts the same reference numbers as FIG. 1 but are accompanied by the lower case letter "e" instead of the lower case letter "a". Furthermore, the embodiment shown in FIG. 5 is only described to the extent that it differs from the embodiments shown previously whose description expressly applies unless otherwise indicated.

Coating machine 10*e* shown in FIG. 5, differs from coating machine 10*d* shown in FIG. 4 mainly by the fact that joint element 80*e*, mounted in joint socket 82*e* of first shell-like piece 70*e* in a manner allowing it to pivot, is not limited only to trailing nozzle lip 26*e* but is also applied to feed-side nozzle lip 32*e*, which also includes joint element 84*e* mounted in joint socket 86*e* of second shell-like piece 72*e* in a manner allowing it to pivot. This allows not only nozzle height 58*e* of discharge nozzle 22*e* to be varied but also the direction of coating medium 12*e* leaving discharge nozzle 22*e*. Furthermore, both nozzle lips 26*e* and 32*e* are extensions of blade elements 30*e* and 88*e*, respectively, which are mounted in joint elements 80*e* and 84*e*. With respect to the delimitation of distribution channel 16*e* and equalization chamber 20*e* by shell-like pieces 70*e* and 72*e*, as well as with respect to insert 78*e* with through-holes 18*e*, reference is made to the description of the embodiment of FIG. 4.

Figure 6:
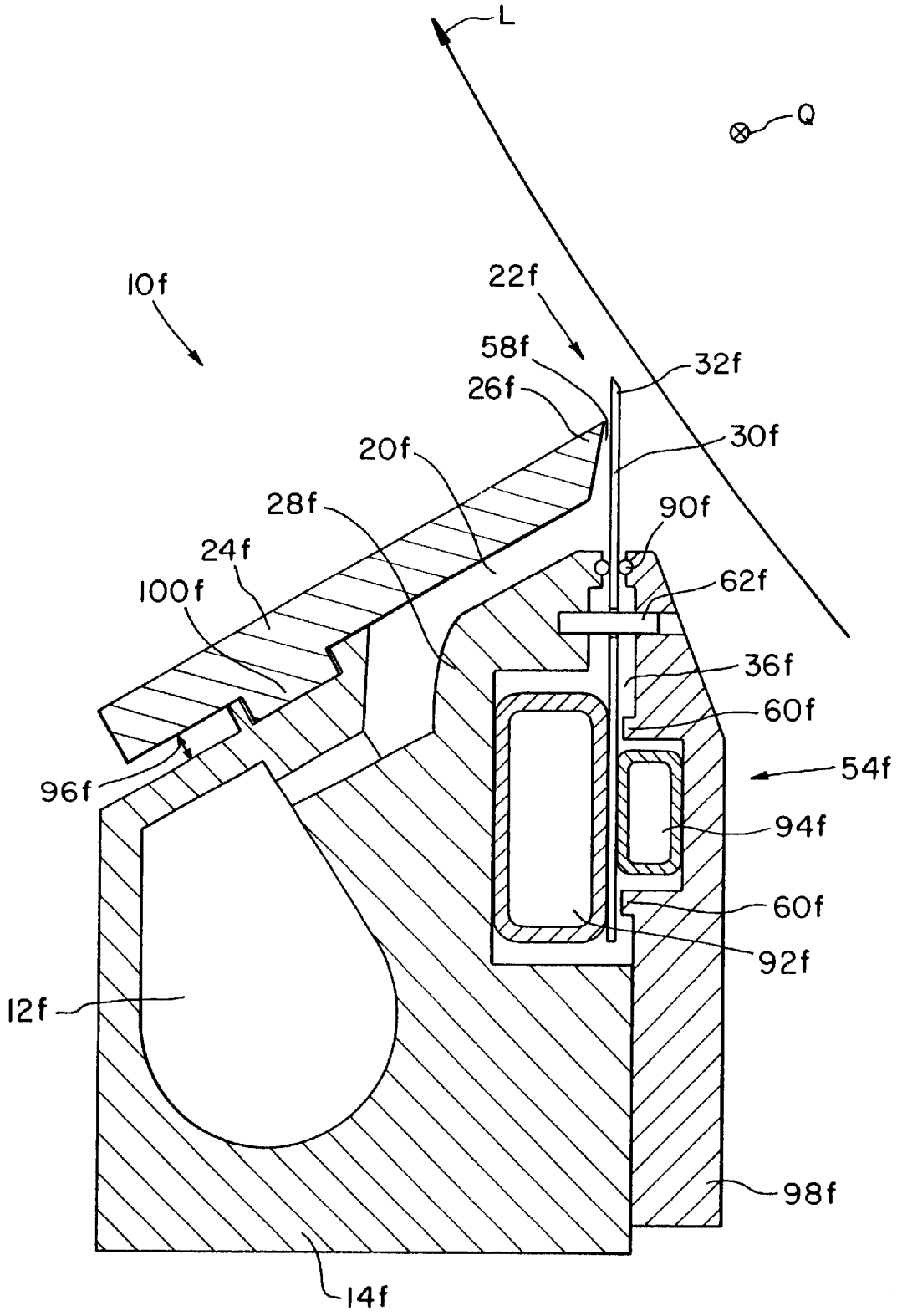

FIG. 6 depicts an additional embodiment of a coating machine of the present invention and essentially relates to the discussions of the previous embodiments. FIG. 6 uses for the same parts the same reference numbers as FIG. 1 but are accompanied by the lower case letter "f" instead of the lower case letter "a". Furthermore, the embodiment shown in FIG. 6 is only described to the extent that it differs from the embodiments shown previously whose description expressly applies unless otherwise indicated.

Similar to the embodiment of FIG. 5, coating machine 10*f*, as shown in FIG. 6, is also equipped with adjustable nozzle lip 32*f* on blade element 30*f*, as well as nozzle lip 26*f* formed by delimiting element 24*f* for first equalization chamber 20*f*.

Blade element 30*f*, which is secured by safety dowel 62*f* in mounting cavity 36*f*, is mounted on pivot bearing 90*f* formed of two round cords. One of the round cords resides in a cavity in second equalization chamber-delimiting element 28*f* which is formed as a single piece item together with distribution pipe 14*f*, while the second round cord resides in a cavity in cover element 98*f*. Adjusting mechanism 54*f* for blade element 30*f* includes two pressure hose arrangements 92*f* and 94*f*, which act upon blade element 30*f* in opposite directions. Pressure hose arrangement 92*f* forces blade element 30*f* against mechanical stop 60*f* during operation of coating machine 10*f*.

Adjusting mechanism 96*f* (schematically shown by a double arrow) for first equalization chamber-delimiting element 24*f*, which includes nozzle lip 26*f*, is mounted on distribution pipe 14*f* at location 100*f* in a manner allowing it to be pivoted.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coating machine for applying a liquid or viscid coating medium onto a moving surface, the moving surface being an outer surface of one of a material web and a transfer element, the material web being one of a paper web and a cardboard web, said coating machine for one of direct and indirect application of the coating medium onto the moving surface, the moving surface being the outer surface of a material web in the case of direct application, the moving surface being the outer surface of a transfer element in the case of indirect application, the moving surface having a feed direction, said coating machine comprising:

a discharge nozzle configured for discharging the coating medium onto the moving surface, a feed side of said discharge nozzle being a side of said discharge nozzle facing a portion of the moving surface located upstream of said discharge nozzle relative to the feed direction, a trailing side of said discharge nozzle being a side of said discharge nozzle facing a portion of the moving surface located downstream of said discharge nozzle relative to the feed direction, said discharge nozzle including a first nozzle lip and a second nozzle lip, said first nozzle lip residing on said feed side of said discharge nozzle, said second nozzle lip residing on said trailing side of said discharge nozzle, at least one of said first nozzle lip and said second nozzle lip comprising a blade element, said discharge nozzle including a nozzle gap between said first nozzle lip and said second nozzle lip, at least one of said first nozzle lip and said second nozzle lip is elastic for at least one of increasing and decreasing said nozzle gap.

2. The coating machine of claim 1, wherein the transfer element is a transfer roll configured for transferring the coating medium onto the material web.

3. The coating machine of claim 1, wherein said first nozzle lip and said second nozzle lip define a nozzle gap therebetween, a distance between said first nozzle lip and said second nozzle defining a nozzle gap height, said coating machine further comprising an adjustment mechanism operatively connected with said discharge nozzle, said adjustment mechanism being configured to adjust the nozzle gap height.

4. A coating machine for applying a liquid or viscid coating medium onto a moving surface, the moving surface being an outer surface of one of a material web and a transfer element, the material web being one of a paper web and a cardboard web, said coating machine for one of direct and indirect application of the coating medium onto the moving surface, the moving surface being the outer surface of a material web in the case of direct application, the moving surface being the outer surface of a transfer element in the case of indirect application, the moving surface having a feed direction, said coating machine comprising:

a discharge nozzle configured for discharging the coating medium onto the moving surface, a feed side of said discharge nozzle being a side of said discharge nozzle facing a portion of the moving surface located upstream of said discharge nozzle relative to the feed direction, a trailing side of said discharge nozzle being a side of said discharge nozzle facing a portion of the moving surface located downstream of said discharge nozzle relative to the feed direction, said discharge nozzle including a first nozzle lip and a second nozzle lip, said first nozzle lip residing on said feed side of said discharge nozzle, said second nozzle lip residing on said trailing side of said discharge nozzle, at least one of said first nozzle lip and said second nozzle lip comprising a blade element, said first nozzle lip and said second nozzle lip define a nozzle gap therebetween, a distance between said first nozzle lip and said second nozzle defining a nozzle gap height, said coating machine further comprising an adjustment mechanism operatively connected with said discharge nozzle, said adjustment mechanism being configured to adjust the nozzle gap height, said adjustment mechanism is operatively connected to said blade.

5. The coating machine of claim 4, wherein said adjustment mechanism is capable of one of bending and pivoting said blade element.

6. The coating machine of claim 4, wherein said blade element has an initial base position, said initial base position of said blade element being unaffected by said adjusting mechanism, an increasing activation of said adjusting mechanism increasing said nozzle gap height, starting from said initial base position of said blade element.

7. The coating machine of claim 4, wherein said blade element has two length-wise edges, said blade element being mounted to said coating machine with one of said length-wise edges, said length-wise edge to which said blade element is mounted thereby defining a mounting edge, said blade element being supported by said coating machine at a support position, said support position being located between said two length-wise edges, said adjusting mechanism being configured to act upon said blade element at a position between said support position and said mounting edge extending in a length-wise direction.

8. The coating machine of claim 4, wherein said blade element has an initial base position, said initial base position of said blade element being unaffected by said adjusting mechanism, an increasing activation of said adjusting mechanism decreasing said nozzle gap height, starting from said initial base position of said blade element.

9. The coating machine of claim 1, wherein said coating mechanism further includes a pivot bearing located proximate said blade element, said blade element being mounted in said pivot bearing.

10. The coating machine of claim 4, wherein said adjustment mechanism comprises a first partial adjustment mechanism and a second partial adjustment mechanism, said first partial adjustment mechanism and said second partial adjustment mechanism being configured to act upon said blade element in opposite directions relative to each other.

11. The coating machine of claim 5, further comprising a mechanical stop, said mechanical stop being configured for defining a maximum one of a deflection and a pivot movement of said blade element.

12. The coating machine of claim 1, further comprising both a mounting receptacle in which said blade element is mounted and a safety element which interacts with said blade element and thereby secures said blade element in said mounting receptacle.

13. The coating machine of claim 5, wherein said adjustment mechanism has a pivot unit for pivoting said blade element, said pivot unit comprising at least one pivoting lever, each pivoting lever including a fulcrum arrangement, said fulcrum arrangement of each pivoting lever having a first free end and a second free end, said first free end coacting with said blade element, said fulcrum arrangement having at least one force-generating device associated therewith, said at least one force-generating device associated therewith being capable of moving said second free end thereof, each force-generating device including a force-generating arrangement.

14. The coating machine of claim 13, further including a distribution pipe for distributing the coating medium and a pivot bearing, said blade element being mounted in said pivot bearing, said pivot bearing being attached to one of said distribution pipe and a part which is connected to said distribution pipe.

15. The coating machine of claim 13, further including a distribution pipe for distributing the coating medium, said at least one force-generating device associated with said fulcrum arrangement being attached to one of said distribution pipe and a part which is connected to said distribution pipe.

16. The coating machine of claim 4, further comprising a first mounting arrangement, said blade element being mounted in said first mounting arrangement, said adjusting mechanism being configured for positionally adjusting said first mounting arrangement.

17. The coating machine of claim 16, wherein said first mounting arrangement comprises a cylinder segment-shaped joint element.

18. The coating machine of claim 17, further including a distribution pipe for distributing the coating medium, said first mounting arrangement further including a first joint socket, said first joint socket being a part of one of said distribution pipe and a member connected to said distribution pipe, said cylinder segment-shaped joint element being seated in said first joint socket.

19. A coating machine for applying a liquid or viscid coating medium onto a moving surface, the moving surface being an outer surface of one of a material web and a transfer element, the material web being one of a paper web and a cardboard web, said coating machine for one of direct and indirect application of the coating medium onto the moving surface, the moving surface being the outer surface of a material web in the case of direct application, the moving surface being the outer surface of a transfer element in the case of indirect application, the moving surface having a feed direction, said coating machine comprising:

a discharge nozzle configured for discharging the coating medium onto the moving surface, a feed side of said discharge nozzle being a side of said discharge nozzle facing a portion of the moving surface located upstream of said discharge nozzle relative to the feed direction, a trailing side of said discharge nozzle being a side of said discharge nozzle facing a portion of the moving surface located downstream of said discharge nozzle relative to the feed direction, said discharge nozzle including a first nozzle lip and a second nozzle lip, said first nozzle lip residing on said feed side of said discharge nozzle, said second nozzle lip residing on said trailing side of said discharge nozzle, at least one of said first nozzle lip and said second nozzle lip comprising a blade element, said first nozzle lip and said second nozzle lip define a nozzle gap therebetween, a distance between said first nozzle lip and said second nozzle defining a nozzle gap height, said coating machine further comprising an adjustment mechanism operatively connected with said discharge nozzle, said adjustment mechanism being configured to adjust the nozzle gap height, one of said first nozzle lip and said second nozzle lip comprises a blade element, an other of said first nozzle lip and said second nozzle lip lacking a blade element, said adjustment mechanism not configured for affecting said one of said first nozzle lip and said second nozzle lip which comprises a blade element, said adjustment mechanism configured for affecting said other of said first nozzle lip and said second nozzle lip.

20. The coating machine of claim 18, further comprising a second mounting arrangement including a second joint socket, and wherein one of said first nozzle lip and said second nozzle lip comprises a blade element, an other of said first nozzle lip and said second nozzle lip comprising a cylinder segment-shaped joint element, said other of said first nozzle lip and said second nozzle lip being mounted in said second joint socket and capable of being moved by said adjustment mechanism.

21. The coating machine of claim 20, wherein said second joint socket is a part of one of said distribution pipe and a member connected to said distribution pipe.

22. The coating machine of claim 19, further comprising a joint element, said other of said first nozzle lip and said second nozzle lip comprises a lip element, said joint element holding said lip element.

23. The coating machine of claim 19, further comprising a joint element, said other of said first nozzle lip and said second nozzle lip comprises a lip element, said joint element and said lip element being integrally formed.

24. The coating machine of claim 19, further comprising a joint element, said other of said first nozzle lip and said second nozzle lip comprising a lip element, said joint element one of holding and being integrally formed with said lip element, said joint element having an essentially tear-shaped cross-section.

25. The coating machine of claim 17, wherein said joint element has a plurality of ends, said adjustment mechanism being configured for acting upon at least one of said ends of said joint element.

26. The coating machine of claim 19, further comprising a joint element, said other of said first nozzle lip and said second nozzle lip comprising a lip element, said joint element one of holding and being integrally formed with said lip element, said joint element having a plurality of ends, said adjustment mechanism being configured for acting upon at least one of said ends of said joint element.

27. A coating machine for applying a liquid or viscid coating medium onto a moving surface, the moving surface being an outer surface of one of a material web and a transfer element, the material web being one of a paper web and a cardboard web, said coating machine for one of direct and indirect application of the coating medium onto the moving surface, the moving surface being the outer surface of a material web in the case of direct application, the moving surface being the outer surface of a transfer element in the case of indirect application, the moving surface having a feed direction, said coating machine comprising:

a discharge nozzle configured for discharging the coating medium onto the moving surface, a feed side of said discharge nozzle being a side of said discharge nozzle facing a portion of the moving surface located upstream of said discharge nozzle relative to the feed direction, a trailing side of said discharge nozzle being a side of said discharge nozzle facing a portion of the moving surface located downstream of said discharge nozzle relative to the feed direction, said discharge nozzle including a first nozzle lip and a second nozzle lip, said first nozzle lip residing on said feed side of said discharge nozzle, said second nozzle lip residing on said trailing side of said discharge nozzle, at least one of said first nozzle lip and said second nozzle lip comprising a blade element, said first nozzle lip and said second nozzle lip define a nozzle gap therebetween, a distance between said first nozzle lip and said second nozzle defining a nozzle gap height, said coating machine further comprising an adjustment mechanism operatively connected with said discharge nozzle, said adjustment mechanism being configured to adjust the nozzle gap height, said coating machine has at least one said adjustment mechanism, each nozzle lip having an adjusting mechanism associated therewith.

28. A coating machine for applying a liquid or viscid coating medium onto a moving surface, the moving surface being an outer surface of one of a material web and a transfer element, the material web being one of a paper web and a cardboard web, said coating machine for one of direct and indirect application of the coating medium onto the moving surface, the moving surface being the outer surface of a material web in the case of direct application, the moving surface being the outer surface of a transfer element in the case of indirect application, the moving surface having a feed direction, said coating machine comprising:

a supply of the coating medium, said supply configured for establishing a supply flow of the coating medium and a corresponding supply flow direction thereof;

at least two shell-shaped pieces, said shell-shaped pieces together forming delimiting walls of a distribution channel, said distribution channel receiving said supply flow; and a discharge nozzle positioned downstream relative to said supply flow direction from and in fluid communication with said distribution channel, said discharge nozzle being configured for discharging the coating medium onto the moving surface, said at least two shell-shaped pieces connected by at least one bolted connection, at least one said bolted connection including an insert having at least one through-hole allowing the coating medium to transfer from said distribution channel to said discharge nozzle.

29. The coating machine of claim 28, wherein said shell-shaped pieces together further form an equalization chamber, said equalization chamber being located between said distribution channel and said discharge nozzle.

30. A coating machine for applying a liquid or viscid coating medium onto a moving surface, the moving surface being an outer surface of one of a material web and a transfer element, the material web being one of a paper web and a cardboard web, said coating machine for one of direct and indirect application of the coating medium onto the moving surface, the moving surface being the outer surface of a material web in the case of direct application, the moving surface being the outer surface of a transfer element in the case of indirect application, the moving surface having a feed direction, said coating machine comprising:

a supply of the coating medium, said supply configured for establishing a supply flow of the coating medium and a corresponding supply flow direction thereof;

a discharge nozzle configured for receiving the supply flow of the coating medium and for discharging the coating medium onto the moving surface;

at least one distribution channel wall, said at least one distribution channel wall collectively forming a distribution channel, said distribution channel being located in fluid communication with and upstream of said discharge nozzle with respect to the supply flow direction;

at least one equalization chamber wall, said at least one equalization chamber wall collectively forming an equalization chamber; said equalization chamber being located between said distribution channel and said discharge nozzle, a transitional section being located between said distribution channel and said equalization chamber; and an insert positioned in said transitional section, said insert having a plurality of through-holes therein, said through-holes being structured and arranged to establish fluid communication between said distribution channel and said equalization chamber wall and thereby permit the coating medium to flow from said distribution channel to said equalization chamber.

31. The coating machine of claim 30, further comprising a distribution pipe and an associated carrier element, said distribution pipe configured for distributing the coating medium toward said discharge nozzle, said distribution pipe being carried by but separate from said distribution pipe.

32. The coating machine of claim 31, wherein said distribution pipe is mounted so as to be thermally isolated from said associated carrier element.

* * * * *